US008883713B2

(12) United States Patent
Parrish et al.

(10) Patent No.: US 8,883,713 B2
(45) Date of Patent: Nov. 11, 2014

(54) FABRIC SOFTENER ACTIVE COMPOSITION

(71) Applicant: Evonik Industries AG, Essen (DE)

(72) Inventors: Dennis A. Parrish, Sandston, VA (US); Jens P. Hildebrand, Midlothian, VA (US); Miyako Hisamoto, Glen Allen, VA (US)

(73) Assignee: Evonik Industries AG, Essen (DE)

( * ) Notice: Subject to any disclaimer, the term of this patent is extended or adjusted under 35 U.S.C. 154(b) by 4 days.

(21) Appl. No.: 13/754,266

(22) Filed: Jan. 30, 2013

(65) Prior Publication Data

US 2013/0196894 A1 Aug. 1, 2013

Related U.S. Application Data

(60) Provisional application No. 61/592,248, filed on Jan. 30, 2012.

(51) Int. Cl.

| | |
|---|---|
| ***C11D 1/645*** | (2006.01) |
| ***C11D 3/20*** | (2006.01) |
| ***C11D 3/43*** | (2006.01) |
| ***C11D 1/62*** | (2006.01) |
| ***C11D 3/00*** | (2006.01) |

(52) U.S. Cl.

CPC ..... *C11D 3/0015* (2013.01); *C11D 3/2068* (2013.01); *C11D 3/43* (2013.01); *C11D 1/62* (2013.01); *C11D 3/2003* (2013.01)

USPC ..... 510/527; 510/522

(58) Field of Classification Search

USPC ..... 510/522, 527

See application file for complete search history.

(56) References Cited

U.S. PATENT DOCUMENTS

| | | | |
|---|---|---|---|
| 4,234,627 | A | 11/1980 | Schilling |
| 4,514,461 | A | 4/1985 | Woo |
| 4,747,880 | A | 5/1988 | Berrido et al. |
| RE32,713 | E | 7/1988 | Woo |
| 4,789,491 | A | 12/1988 | Chang et al. |
| 4,882,220 | A | 11/1989 | Ono et al. |
| 4,917,920 | A | 4/1990 | Ono et al. |
| 4,954,285 | A | 9/1990 | Wierenga et al. |
| 5,002,681 | A | 3/1991 | Wierenga et al. |
| 5,137,646 | A | 8/1992 | Schmidt et al. |
| 5,391,325 | A | 2/1995 | Swenson et al. |
| 5,427,697 | A | 6/1995 | Swartley |
| 5,480,567 | A | 1/1996 | Lam et al. |
| 5,703,029 | A | 12/1997 | Crass et al. |
| 5,759,990 | A | 6/1998 | Wahl et al. |
| 5,792,219 | A | 8/1998 | Hartman et al. |
| 5,827,451 | A | 10/1998 | Cummings et al. |
| 5,830,845 | A | 11/1998 | Trinh et al. |
| 5,877,145 | A | 3/1999 | Wahl et al. |
| 5,916,863 | A | 6/1999 | Iacobucci et al. |
| 6,004,913 | A | 12/1999 | Iacobucci et al. |
| 6,037,315 | A | 3/2000 | Franklin et al. |
| 6,180,593 | B1 | 1/2001 | Fender et al. |
| 6,200,949 | B1 | 3/2001 | Reijmer et al. |
| 6,235,914 | B1 | 5/2001 | Steiger et al. |
| 6,255,274 | B1 | 7/2001 | Becherer et al. |
| 6,376,455 | B1 | 4/2002 | Friedli et al. |
| 6,458,343 | B1 | 10/2002 | Zeman et al. |
| 6,492,322 | B1 | 12/2002 | Cooper et al. |
| 6,608,024 | B1 | 8/2003 | DuVal et al. |
| 6,645,479 | B1 | 11/2003 | Shefer et al. |
| 6,653,275 | B1 | 11/2003 | Fender et al. |
| 6,770,608 | B2 | 8/2004 | Franklin et al. |
| 6,897,194 | B2 | 5/2005 | Fan et al. |
| 6,987,074 | B2 | 1/2006 | Ishii et al. |
| 7,572,761 | B2 | 8/2009 | Gefvert |
| 7,704,940 | B2 | 4/2010 | Boerefijn et al. |
| 7,994,110 | B2 | 8/2011 | Wenk et al. |
| 8,183,199 | B2 | 5/2012 | Fossum et al. |
| 8,361,953 | B2 | 1/2013 | Nagy et al. |
| 2001/0004635 | A1* | 6/2001 | Wahl et al. ..... 510/515 |
| 2002/0025915 | A1* | 2/2002 | Franklin et al. ..... 510/515 |
| 2003/0060390 | A1 | 3/2003 | Demeyere et al. |
| 2003/0158344 | A1 | 8/2003 | Rodriques et al. |
| 2003/0165692 | A1 | 9/2003 | Koch et al. |
| 2003/0195130 | A1 | 10/2003 | Lentsch et al. |
| 2003/0195133 | A1 | 10/2003 | Shefer et al. |
| 2003/0203829 | A1 | 10/2003 | Shefer et al. |
| 2003/0215417 | A1 | 11/2003 | Uchiyama et al. |
| 2003/0216282 | A1 | 11/2003 | Martens et al. |
| 2003/0216488 | A1 | 11/2003 | Uchiyama et al. |

(Continued)

FOREIGN PATENT DOCUMENTS

| | | |
|---|---|---|
| CA | 1312619 | 1/1993 |
| CS | 246532 | 3/1986 |

(Continued)

OTHER PUBLICATIONS

International Search Report for related PCT application, PCT/EP2012/076357, filed Dec. 20, 2012.

Written Opinion of the International Searching Authority for related PCT application PCT/EP2012/076357 filed Dec. 20, 2012.

International Search Report for related PCT application, PCT/EP2013/051753, filed Jan. 30, 2013.

Written Opinion of the International Searching Authority for related PCT application, PCT/EP2013/051753, filed Jan. 30, 2013.

(Continued)

*Primary Examiner* — John Hardee

(74) *Attorney, Agent, or Firm* — Law Office of: Michael A. Sanzo, LLC

(57) ABSTRACT

The present invention is directed to compositions that are characterized by the presence of ester quats with specific characteristics that promote dispersibility at low temperature. Among the important characteristics of the ester quats are an iodine value of 65-85 and distribution of: 33-38% monoesters, 50-55% diesters and 7-12% triesters.

20 Claims, No Drawings

(56) References Cited

U.S. PATENT DOCUMENTS

| | | | |
|---|---|---|---|
| 2003/0220210 | A1 | 11/2003 | DuVal et al. |
| 2004/0071742 | A1 | 4/2004 | Popplewell et al. |
| 2004/0071746 | A1 | 4/2004 | Popplewell et al. |
| 2004/0072719 | A1 | 4/2004 | Bennett et al. |
| 2004/0072720 | A1 | 4/2004 | Brain et al. |
| 2004/0087477 | A1 | 5/2004 | Ness |
| 2004/0106536 | A1 | 6/2004 | Mane et al. |
| 2004/0167056 | A1 | 8/2004 | Lentsch et al. |
| 2004/0204337 | A1 | 10/2004 | Corona et al. |
| 2005/0014672 | A1 | 1/2005 | Arif |
| 2005/0032671 | A1 | 2/2005 | Kvita et al. |
| 2006/0089293 | A1 | 4/2006 | Frankenbach |
| 2006/0094639 | A1 | 5/2006 | Martin et al. |
| 2006/0142175 | A1 | 6/2006 | Haiss et al. |
| 2006/0252669 | A1 | 11/2006 | Heibel et al. |
| 2006/0277689 | A1 | 12/2006 | Hubig et al. |
| 2007/0054835 | A1 | 3/2007 | Corona et al. |
| 2007/0066510 | A1 | 3/2007 | Tee et al. |
| 2007/0219111 | A1 | 9/2007 | Ward et al. |
| 2008/0242584 | A1 | 10/2008 | Wahl et al. |
| 2008/0263780 | A1 | 10/2008 | Declercq et al. |
| 2008/0289116 | A1 | 11/2008 | Young et al. |
| 2009/0124533 | A1 | 5/2009 | Kottke et al. |
| 2009/0181877 | A1 | 7/2009 | McGinnis et al. |
| 2009/0203571 | A1 | 8/2009 | Nagy et al. |
| 2011/0110993 | A1 | 5/2011 | Chieffi et al. |
| 2011/0239377 | A1 | 10/2011 | Fossum et al. |
| 2011/0239378 | A1 | 10/2011 | Fossum et al. |
| 2011/0245138 | A1 | 10/2011 | Köhle et al. |
| 2011/0245139 | A1 | 10/2011 | Köhle et al. |
| 2011/0245140 | A1 | 10/2011 | Demeyere |
| 2012/0021959 | A1 | 1/2012 | Morgan, III et al. |
| 2012/0088712 | A1 | 4/2012 | Schick et al. |
| 2013/0053299 | A1 | 2/2013 | Köhle et al. |

FOREIGN PATENT DOCUMENTS

| | | | |
|---|---|---|---|
| DE | 24 30 140 | A1 | 2/1976 |
| DE | 34 02 146 | A1 | 7/1985 |
| DE | 36 08 093 | A1 | 9/1987 |
| DE | 197 08 133 | | 12/1997 |
| EP | 0 284 036 | | 9/1988 |
| EP | 0 293 955 | A2 | 12/1988 |
| EP | 0 302 567 | A2 | 2/1989 |
| EP | 0 421 146 | A2 | 9/1990 |
| EP | 0 829 531 | A1 | 3/1998 |
| EP | 1 018 541 | A1 | 7/2000 |
| EP | 1 323 817 | A1 | 12/2001 |
| EP | 1 393 706 | A1 | 3/2004 |
| EP | 1 584 674 | A1 | 10/2005 |
| EP | 1 840 197 | A1 | 2/2007 |
| EP | 1 806 392 | A1 | 7/2007 |
| GB | 2 007 734 | A | 5/1979 |
| GB | 2 039 556 | | 8/1980 |
| WO | WO 91/01295 | | 2/1991 |
| WO | WO 92/18593 | | 10/1992 |
| WO | WO 94/14935 | | 7/1994 |
| WO | WO 94/19439 | | 9/1994 |
| WO | WO 97/42279 | | 11/1997 |
| WO | WO 98/38277 | | 9/1998 |
| WO | WO 98/52907 | | 11/1998 |
| WO | WO 00/06678 | | 2/2000 |
| WO | WO 01/32813 | A1 | 5/2001 |
| WO | WO 2005/085404 | A1 | 9/2005 |
| WO | WO 2007/026314 | A2 | 3/2007 |
| WO | WO 2007/125005 | | 11/2007 |
| WO | WO 2008/003454 | A1 | 1/2008 |
| WO | WO 2008/104509 | | 9/2008 |
| WO | WO 2009/018955 | A2 | 2/2009 |
| WO | WO 2009/099618 | A1 | 8/2009 |
| WO | WO 2011/120836 | A1 | 10/2011 |
| WO | WO 2011/123284 | A1 | 10/2011 |
| WO | WO 2011/123606 | A1 | 10/2011 |
| WO | WO 2011/123733 | A1 | 10/2011 |

OTHER PUBLICATIONS

English language translation of CS 246532, listed as document B2 above.

English language abstract for DE 24 30 140, listed as document B3 above.

English language abstract for DE 34 02 146 Al, listed as document B4 above.

English language abstract for DE 36 08 093, listed as document B5 above.

English language abstract for DE 197 08 133, listed as document B6 above.

English language abstract for EP 0 284 036, listed as document B7 above.

English language abstract for EP 0 421 146 A2, listed as document B10 above.

English language abstract for EP 1 018 541, listed as document B12 above.

English language abstract for EP 1 323 817 A1, listed as document B13 above.

English language abstract for WO 91/01295, listed as document B19 above.

English language abstract for WO 94/14935, listed as document B21 above.

English language abstract for WO 2007/125005, listed as document B28 above.

English language abstract for WO 2009/018955 A2, listed as document B31 above.

Second English language abstract for WO 2009/018955 A2, listed as document B31 above.

Akram, et al., "Synthesis of Tallow Based Esterquat," *J. Sci. Res.* vol. XXX(1):31-36 (Jun. 1, 2010).

Price-Jones, et al., "*N,N*-ethylenediyl-*bis*-alkanamides: Differential scanning calorimetry studies,"*J. Am. Oil Chem. Soc. 73*:311-319 (1996).

Product Advertisement for Tetranyl AO-1, http//kaochemicals-eu.com/213.html, downloaded Jul. 27, 2011.

Ullman's Encyclopedia of Industrial Chemistry; Wiley-VCH Verlag GmbH & Co. KGaA, Weinheim, vol. 14, Table 2, p. 77 (2012).

* cited by examiner

FABRIC SOFTENER ACTIVE COMPOSITION

CROSS REFERENCE TO RELATED APPLICATIONS

The present application claims the benefit of U.S. provisional application 61/592,248, filed on Jan. 30, 2012.

FIELD OF THE INVENTION

The present invention relates to ester quat compositions with good dispersibility at temperatures of 30° C. or lower. The compositions should be of particular value in the formation of fabric softeners for use in laundering procedures.

BACKGROUND OF THE INVENTION

Quaternary ammonium salts of alkanolamines esterified with an average of two fatty acid moieties per molecule, commonly referred to as ester quats, have found broad use as fabric softeners. One problem with the use of these compounds is that they are typically difficult to disperse in water or aqueous solutions at temperatures below about 40° C. This can make the preparation of formulations more difficult and expensive.

One attempt to address problems of ester quat dispersibility was made by Gallotti et al. (WO 2008/003454). This reference discloses concentrated ester quat compositions that can be used in fabric softeners and which are especially suitable for use in low temperature processes. The compositions contain (a) an ester quat compound, specifically di(ethyl ester) dimethylammonium chloride (DEEDMAC) type (b) an organic solvent, (c) water, and (d) stabilizers.

U.S. Pat. No. 5,830,845 discloses concentrated aqueous fabric softening compositions that can be made at ambient temperature. The actives described have fatty acid alkyl moieties with iodine values higher than 80. In general compositions have a polyunsaturated content of more than 10%, and a monoester quat content below 20% by weight.

EP 1 584 674 A1 discloses ester quat concentrates which it suggests can be used for the production of fabric softeners at lower temps. The compositions contain: (a) an ester quat compound, (b) an organic solvent, (c) water, and (d) a pH modifier. The reference suggests that water is essential for dispersibility at low temperature.

WO 97/42279 discloses triethanolamine ester quat concentrates to be used for the production of fabric softeners. The compositions comprise greater than 55% by weight diester quat and less than 25% by weight triester quat, based on the total amount of quaternary ammonium salts. Dispersing these ester quat concentrates in water to make an aqueous fabric softener requires preheating water to 45-60° C.

Despite the efforts that have been made, there is still a need for improved ester quat compositions that can be easily dispersed in water or aqueous solutions at low temperatures and that maintain the ability to act effectively as fabric softeners.

SUMMARY OF THE INVENTION

The present invention is directed to compositions that contain ester quats with good dispersibility at low temperatures. The compositions may be used as fabric softeners in laundry processes.

In its first aspect, the invention is directed to a fabric softener active composition, containing one or more ester quats of formula (I):

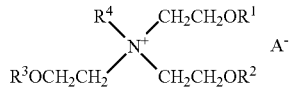

(I)

wherein $R^1$, $R^2$ and $R^3$ are hydrogen or a group $C(O)R^5$;

$R^5$ is an alkyl or alkenyl group comprising 11 to 21 carbon atoms;

$A^-$ is a fabric softener compatible anion;

$R^4$ is methyl or ethyl.

The fabric softener compatible anion $A^-$ is preferably methyl sulfate or ethyl sulfate and most preferably methyl sulfate. Group $R^4$ is preferably methyl.

On a normalized weight percent basis, 33-38% of the ester quats are monoesters, e.g., $R^1$ is a group $C(O)R^5$ and $R^2$ and $R^3$ are hydrogen; 50-55% are diesters, e.g., $R^1$ and $R^2$ are a $C(O)R^5$ group and $R^3$ is hydrogen; and 7-12% are triesters, i.e. R', $R^2$ and $R^3$ are a group $C(O)R^5$. The normalized weight percent basis is the sum of the weights of monoesters, diesters and triesters. Preferably, 52-55% of the ester quats are diesters.

The $R^5$ groups can be derived from a pure fatty acid $R^5COOH$ or a mixture of fatty acids of formula $R^5COOH$, where $R^5$ is a branched or unbranched alkyl or alkenyl group and preferably is unbranched. Examples of suitable saturated fatty acids are palmitic acid and stearic acid. Examples of suitable monounsaturated fatty acids are oleic acid and palmitoleic acid. It is also preferred that the alkyl or alkenyl chains of group $R^5$ in formula (I) have an average chain length of 15 to 17 carbon atoms. The average chain length is calculated on the basis of the weight fraction of individual fatty acids in the mixture of fatty acids. For branched chain fatty acids the chain length refers to the longest consecutive chain of carbon atoms.

The iodine value of the $R^5$ groups, calculated for the free fatty acid $R^5COOH$, is from 65 to 85, preferably from 65 to 75 and most preferably about 70. The iodine value is a measure of the degree of unsaturation of esterified fatty acid carbon chains, i.e., the amount of iodine in grams consumed by the reaction of the double bonds of 100 g of fatty acid. The iodine value can be determined by the method of ISO 3961. The $R^5$ groups preferably have a polyunsaturation level of less than 10%. The iodine value range of $R^5$ groups described herein provides liquidity and dispersibility at temperatures below 30° C., as well as good softening performance. The combination of the range of monoester content and the iodine value is of particular importance. In the iodine range of 65 to 85 and in particular of 65 to 75, monoester values below about 33 wt % tend to result in compositions that are too viscous for convenient use in the procedures described herein and generally assume a paste-like structure. As diester values increase substantially above 55 wt %, dispersibility at temperatures below about 30° C. tends to decrease.

Preferably, the cis to trans ratio of the unsaturated bonds of $R^5$ alkenyl groups is less than 12:1 and, more preferably, between 5:1 and 9:1.

The fabric softener active compositions should contain 10-25% of an alcoholic solvent such as ethanol, 2-propanol, glycerol, ethylene glycol, propylene glycol, dipropylene glycol or a $C_1$-$C_4$ alkyl monoether of ethylene glycol.

At a temperature of greater than 15° C. and up to at least 25° C., the fabric softener active composition is in the form of a transparent liquid.

The ester quats according to formula (I) should preferably be present in fabric softening active compositions at a level above 50%. These fabric softener active compositions may be used combined with water and other components to form aqueous fabric softeners that can be used in the laundering of fabrics.

Liquid aqueous fabric softener compositions can be made by mixing the fabric softener active compositions described above with water or an aqueous solution at a temperature of 0-30° C., preferably 5-25° C. and more preferably 15-25° C. After mixing, the aqueous fabric softener compositions will typically have 2-30% by weight of ester quats according to formula I. The fabric softening active composition or aqueous solution may also optionally include additives such as viscosity aids, preservatives, or thickeners. Fragrant aqueous fabric softeners may be made by including a perfume in the fabric softener active composition and then mixing this with an aqueous solution according to the procedure described above or by concurrently mixing fabric softening active composition and perfume with water or an aqueous solution.

As a fabric softener, the ester quat compositions described herein may be used either as a liquid aqueous fabric softener composition in the rinse cycle of washing machines or as a dryer activated composition that is added at the time that fabrics are tumble dried. In the latter case, the fabric softeners will generally be in the form of dryer sheets comprised of a substrate of non-woven material impregnated with an aqueous dispersion of the fabric softening active compositions described herein. Examples of substrate sheets include, but are not limited to, cellulose fibers or synthetic fibers, particularly polyester, nylon, or polypropylene fibers. The invention includes both methods of washing a fabric in which a fabric is contacted with the aqueous fabric softener as described herein (e.g., by contacting the fabric with the aqueous fabric softener in a washing machine during the rinse cycle) and methods of treating a fabric by drying it in a dryer in the presence of one or more dryer sheets as described above.

DESCRIPTION OF THE INVENTION

Preparation of Fabric Softener Active Compositions

The ester quats of the present invention can be made by esterifying triethanolamine with free fatty acids or triglycerides, optionally in the presence of a solvent or catalyst. A molar ratio of fatty acid to amine of from 1.40:1 to 1.70:1, and preferably from 1.45:1 to 1.60:1, may be used. The reaction can be carried out at a temperature of from 90 to 220° C. The most preferred molar ratio of fatty acid to amine is 1.50 to 1. The reaction can be stopped by cooling to a temperature below about 80° C. Water may be removed by distillation from the reaction mixture, optionally with a reduction of pressure.

The average fatty acid chain length and iodine value are important for achieving a combination of good performance and good dispersibility at temperatures of 5-30° C. Fatty acids used in the esterification should have an average chain length of from 12-22 carbons and an iodine value of from 65 to 85, preferably from 65 to 75. They may be either synthetic or from a natural source such as, for example, tallow, canola, soybean or palm oil. Average chain length is calculated on the basis of the weight fraction of individual fatty acids in the mixture. The required iodine value can be obtained by using a fatty acid mixture of natural origin that already has the desired value, by mixing compositions of different iodine values or by partial hydrogenation of a fatty acid mixture or a triglyceride mixture having a higher iodine value. The cis-trans-ratio of double bonds of unsaturated fatty acid moieties is preferably between 5:1 and 9:1.

In a second step, the triethanolamine fatty acid esters are quaternized with a suitable quaternizing reagent such as dimethyl sulfate. The molar ratio of quaternizing reagent to amine should generally be from 0.90 to 0.97 and the reaction should be carried out at a temperature of from 60 to 100° C. until the total amine value of the reaction mixture is in the range from 1 to 8 mg KOH/g. The total amine value is determined by non-aqueous titration with perchloric acid according to method Tf 2a-64 of the American Oil Chemists Society and is calculated as mg KOH per g sample.

Alcoholic solvent is added during or after the quaternizing reaction described above so that the final ester quat active composition has 10-25% solvent by weight.

Preparation of Aqueous Fabric Softeners

The fabric softening active compositions described above are mixed with water or an aqueous solution to form aqueous fabric softener compositions that may be used in laundering procedures. Effective mixing may take place at 5-30° C., preferably at 5-25° C. and more preferably at 15-25° C. Mixing may take place under conditions of low shear and in the absence of any other agents that promote dispersion. This will result in the formation of a liquid dispersion at the temperature at which mixing occurs, e.g., at 15-20° C. In contrast to the fabric softening active composition, the resulting aqueous fabric softener composition is in general opaque. Other ingredients that may be added to aqueous compositions include, but are not limited to, fragrances, preservatives, thickeners, dyes, and optical brighteners.

Use of Aqueous Fabric Softeners

The compositions described herein can be used in a wide variety of cleaning procedures but it is believed that they will be of particular value in clothes washing procedures. Typically, these cleaning operations involve an initial step in which dirt is removed using detergents, followed by a rinse procedure in which detergent that has been applied is removed. It is in the latter, rinse step, that the compositions described herein would usually be used.

Preparation of Dryer Activated Fabric Softener Sheet

The fabric softening active compositions described above may be mixed with water or an aqueous solution and applied to a non-woven substrate to make a dryer activated sheet suitable for use in tumble dryers. Such dryer activated sheets are prepared by mixing fabric softening active compositions with water to form an aqueous dispersion, which is subsequently brought into contact with or applied to the substrate. The aqueous dispersion may optionally contain further ingredients including, but not limited to, nonflammable solvents, auxiliary surfactants, preservatives, viscosity aids, and fragrances.

Use of Dryer Activated Fabric Softener Sheet

The dryer activated sheets described above can be used after the washing and rinsing procedure during the drying cycle in tumble dryers. The dryer sheet is added to the tumble dryer along with damp laundry. During the drying cycle, the composition is distributed to the fabric to provide a softening and antistatic effect as well as optionally delivering fragrance and further active ingredients.

The invention is illustrated by the following nonlimiting examples.

EXAMPLES

All examples were carried out with triethanolamine ester quat fabric softener actives that were prepared by esterification of triethanolamine with fatty acid, followed by quaternization with dimethyl sulfate. The fabric softener actives contained ethanol as solvent unless specified otherwise. Fatty acids, their iodine value and fraction of polyunsaturated fatty acids, and molar ratios of fatty acid (FA) to triethanolamine (TEA) used for preparing the TEA ester quats are listed in table 1. The alcohol content, the normalized contents of monoester quat (MEQ), diester quat (DEQ) and triester quat (TEQ) as determined by NMR, and the appearance of the fabric softener actives are listed in table 2. The mixture of 50 wt-% oleic and 50 wt-% tallow fatty acid had a cis to trans ratio of olefinic bonds of about 7.

TABLE 1

Fatty acid data of TEA ester quats

| Product | Fatty acid | Iodine value | Polyunsaturated fraction in % | FA:TEA molar ratio |
|---|---|---|---|---|
| A* | Tallow FA | 40 | <1 | 1.95:1 |
| B* | Palm FA | 40 | <6 | 1.77:1 |
| C* | Tallow FA | 50 | 5 | 1.70:1 |
| D* | Canola FA | 95 | 11 | 1.88:1 |
| E* | Canola FA | 95 | 11 | 1.77:1 |
| F* | Canola FA | 110 | 25 | 1.55:1 |
| G* | Hydrogenated canola FA | 74 | 0.6 | 1.55:1 |
| H* | 50 wt-% oleic, 50 wt-% tallow FA | 70 | 7 | 1.85:1 |
| I* | 50 wt-% oleic, 50 wt-% tallow FA | 70 | 7 | 1.75:1 |
| J | 50 wt-% oleic, 50 wt-% tallow FA | 70 | 7 | 1.55:1 |
| K | 50 wt-% oleic, 50 wt-% tallow FA | 70 | 7 | 1.50:1 |
| L | 50 wt-% oleic, 50 wt-% tallow FA | 70 | 7 | 1.45:1 |

*Not according to the invention

TABLE 2

Composition and appearance of fabric softener actives

| Product | Solvent in wt-% | MEQ in wt-% | DEQ in wt-% | TEQ in wt-% | Appearance |
|---|---|---|---|---|---|
| A* | 10 | 19 | 56 | 26 | solid |
| B* | 10 | 24 | 55 | 21 | solid |
| C* | 10 | 30 | 56 | 14 | solid |
| D* | 7 | 18 | 56 | 26 | transparent liquid |
| E* | 25** | 24 | 50 | 26 | transparent liquid |
| F* | 14 | 33 | 55 | 12 | transparent liquid |
| G | 14 | 35 | 54 | 11 | turbid liquid |
| H* | 14 | 24 | 55 | 21 | turbid liquid |
| I* | 14 | 26 | 56 | 18 | turbid after 2 months |
| J | 14 | 35 | 53 | 12 | transparent liquid |
| K | 14 | 38 | 51 | 10 | transparent liquid |
| L | 14 | 38 | 53 | 9 | transparent liquid |

*Not according to the invention
**Solvent is dipropylene glycol n-butyl ether

Fabric Softener Formulation at High Temperatures (40-60° C.) with Paste or Solid Products (Comparative Examples)

Deionized water is heated to 50° C. and stirred with an overhead mixer at 500 $min^{-1}$. The fabric softener active, preheated to 50° C. and in a molten state, is added in a slow, steady manner. Calcium chloride as a 25% active solution is added as necessary to maintain a defined vortex. Once the fabric softener active addition is complete, the dispersion is stirred at 50° C. for 10 minutes at 500 $min^{-1}$, and then allowed to cool with continued stirring. Calcium chloride solution is added as necessary to control viscosity during the cooling period. Upon reaching 30° C., optional ingredients such as fragrance, thickener, and preservatives may be added followed by an additional mixing time of 10 minutes. Final adjustments to viscosity are made by adding calcium chloride solution.

Fabric Softener Formulation at Low Temperatures (20-30° C.) with Liquid Products Deionized water is equilibrated to 25° C. and stirred with an overhead mixer at 500 $min^{-1}$. The fabric softener active equilibrated to 25° C. is added in a slow, steady manner. Calcium chloride as a 25% active solution is added as necessary to maintain a defined vortex. Once the fabric softener active addition is complete, the dispersion is stirred at 25° C. for 10 minutes at 500 $min^{-1}$. After mixing, optional ingredients such as fragrance, thickener, and preservatives may be added followed by an additional mixing time of 10 minutes. Final adjustments to viscosity are made by adding calcium chloride solution.

Table 3 summarizes the results that were obtained with products A to L following these fabric softener formulation procedures, using the dispersion temperatures and fabric softener active contents given. Actives contents indicated as target could not be reached, as the mixture gelled before all fabric softener active was added.

TABLE 3

TEA Ester Quat Dispersion Conditions and Results

| Product | Dispersion temperature in ° C. | Actives content in wt-% | Dispersion result |
|---|---|---|---|
| A* | 50 | 15 | Conventional dispersion process; no issues |
| A* | 25 | — | Quat is not liquid; cannot be dispersed |
| B* | 50 | 15 | Conventional dispersion process; no issues |
| B* | 25 | — | Quat is not liquid; cannot be dispersed |
| C* | 50 | 16 | Conventional dispersion process; no issues |
| C* | 25 | — | Quat is not liquid; cannot be dispersed |
| D* | 50 | 15 (target) | Gelled during dispersion |
| D* | 25 | 15 (target) | Gelled during dispersion |
| E* | 45 | 10 (target) | Gelled during dispersion |
| E* | 30 | 20 (target) | Gelled during dispersion |
| F* | 24 | 20 | Not easily dispersed |
| G | 25 | 20 | Easily dispersed |
| H* | 23 | 20 (target) | Gelled during dispersion |
| I* | 23 | 20 | Not easily dispersed |
| J | 30 | 5 | Very easily dispersed |
| J | 20 | 22 | Very easily dispersed |
| J | 21 | 5 | Very easily dispersed |
| J | 23 | 20 | Very easily dispersed |
| K | 23 | 20 | Very easily dispersed |
| L | 22 | 20 | Very easily dispersed |

*not according to the invention

All references cited herein are fully incorporated by reference. Having now fully described the invention, it will be understood by those of skill in the art that the invention may be practiced within a wide and equivalent range of conditions, parameters and the like, without affecting the spirit or scope of the invention or any embodiment thereof.

What is claimed is:

1. A fabric softening active composition, comprising:

a) ester quats of formula (I):

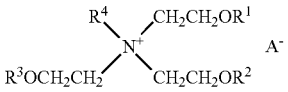

(I)

wherein $R^1$, $R^2$ and $R^3$ are hydrogen or a group $C(O)R^5$;

$R^5$ is an alkyl or alkenyl group comprising 11 to 21 carbon atoms;

$A^-$ is a fabric softener compatible anion;

$R^4$ is methyl or ethyl;

and wherein:

i) on a normalized wt % basis: 33-38% of said ester quats are monoesters; 50-55% of said ester quats are diesters; and 7-12% of said ester quats are triesters; and ii) said $R^5$ groups have an iodine value, calculated for the free fatty acid $R^5COOH$, of from 65 to 85 and the cis to trans ratio of unsaturated bonds of said $R^5$ groups is less than 12:1; and b) 10-25% by weight of an alcoholic solvent.

2. The fabric softening active composition of claim 1, wherein 52-55% of said ester quats are diesters.

3. The fabric softening active composition of claim 1, wherein the iodine value is from 65 to 75.

4. The fabric softening active composition of claim 1, wherein the cis to trans ratio of unsaturated bonds is between 5:1 and 9:1.

5. The fabric softening active composition of claim 1, wherein said $R^5$ groups have a polyunsaturation level of less than 10%.

6. The fabric softening active composition of claim 5 wherein the cis to trans ratio of unsaturated bonds is between 5:1 and 9:1.

7. The fabric softening active composition of claim 1, wherein the average chain length of $R^5$ groups in said ester quats is from 15 to 17 carbon atoms.

8. The fabric softening active composition of claim 1, wherein said alcoholic solvent is ethanol or 2-propanol.

9. The fabric softening active composition of claim 1, wherein said alcoholic solvent is ethylene glycol, propylene glycol, dipropylene glycol or a $C_1$-$C_4$ alkyl monoether of ethylene glycol.

10. The fabric softening active composition of claim 1, wherein ester quats according to formula (I) are present at a level of at least 50% by weight.

11. An aqueous fabric softener composition comprising the fabric softener active composition of claim 1 and sufficient water so that the ester quats of formula (I) are present at 2-30% by weight.

12. The aqueous fabric softener composition of claim 11, further comprising a viscosity aid, preservative, thickener or perfume.

13. A method of making the aqueous fabric softener of claim 11, comprising mixing the fabric softening active composition of claim 1 with water or an aqueous solution at a temperature of 5-30° C.

14. The method of claim 13, wherein said fabric softening active composition and said water or aqueous solution are mixed at a temperature of 5-25° C.

15. The method of claim 13, wherein said fabric softening active composition and said water or aqueous solution are mixed at a temperature of 15-25° C.

16. The method of claim 13, wherein said aqueous fabric softener further comprises a perfume and is made by mixing the fabric softening active composition of claim 1 with a perfume and water, or an aqueous solution, said mixing being carried out at a temperature of 5-30° C.

17. The method of claim 16, wherein said fabric softening active composition and said perfume are concurrently mixed with water or an aqueous solution.

18. The method of claim 16, wherein said fabric softening active composition and said perfume are first mixed at a temperature of 5-30° C. and then mixed with water or an aqueous solution.

19. A dryer activated sheet for use in dryers, comprising a substrate sheet of non-woven material impregnated with an aqueous dispersion of the fabric softening active composition of claim 1.

20. The dryer activated fabric softener sheet of claim 19, wherein said substrate sheet is made from a material selected from the group consisting of: cellulose fibers; synthetic fibers; polyester, nylon, and polypropylene fibers.

* * * * *